US012637774B2

(12) United States Patent
Raftegard et al.

(10) Patent No.: US 12,637,774 B2
(45) Date of Patent: May 26, 2026

(54) PROPELLER ARRANGEMENT IN A CATHODIC PROTECTION SYSTEM

(71) Applicant: VOLVO PENTA CORPORATION, Gothenburg (SE)

(72) Inventors: Viktor Raftegard, Floda (SE); Johan Kallvik, Sollebrunn (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 897 days.

(21) Appl. No.: 17/754,982

(22) PCT Filed: Oct. 18, 2019

(86) PCT No.: PCT/EP2019/078423
§ 371 (c)(1),
(2) Date: Apr. 18, 2022

(87) PCT Pub. No.: WO2021/073759
PCT Pub. Date: Apr. 22, 2021

(65) Prior Publication Data

US 2022/0380907 A1 Dec. 1, 2022

(51) Int. Cl.
*C23F 13/20* (2006.01)
*B63B 59/04* (2006.01)
*B63H 1/20* (2006.01)

(52) U.S. Cl.
CPC ..... *C23F 13/20* (2013.01); *B63B 59/04* (2013.01); *B63H 1/20* (2013.01); *C23F 2213/31* (2013.01)

(58) Field of Classification Search
CPC ..... B63H 1/14–1/265; B63B 59/04
See application file for complete search history.

(56) References Cited

U.S. PATENT DOCUMENTS 3,022,234 A * 2/1962 Anderson ..... C23F 13/04 204/196.03
3,081,251 A 3/1963 Dov
(Continued)

FOREIGN PATENT DOCUMENTS

CN 103088345 A 5/2013
CN 103088345 B 12/2014
(Continued)

OTHER PUBLICATIONS

Siebert ("Steel, Titanium or Aluminum Propellers", Sep. 2019, pp. 1-9). (Year: 2019).*
(Continued)

*Primary Examiner* — Alexander W Keeling
(74) *Attorney, Agent, or Firm* — Jeffri A. Kaminski; Venable LLP

(57) ABSTRACT

The invention relates to a propeller arrangement in a cathodic protection system for a marine vessel with a marine propulsion system, which cathodic protection system comprises a direct current power source with a positive terminal. The propulsion system comprises at least one driveline housing at least partially submerged in water; a torque transmitting drive shaft extending out of the driveline housing; and at least one propeller mounted on the drive shaft. According to the invention, the at least one propeller is electrically isolated from its drive shaft. Each electrically isolated propeller is electrically connected to a slip ring connector, which slip ring connector is in electrical connection with the positive terminal. The invention further relates to a vessel provided with such a propeller arrangement.

14 Claims, 5 Drawing Sheets

(56) References Cited

U.S. PATENT DOCUMENTS

| | | | | |
|---|---|---|---|---|
| 3,169,105 | A * | 2/1965 | Preiser | B63H 1/18 416/223 R |
| 4,592,818 | A | 6/1986 | Cavil et al. | |
| 5,011,583 | A * | 4/1991 | Tanbara | C23F 13/00 114/221 R |
| 6,544,000 | B1 | 4/2003 | Jessup et al. | |
| 7,131,877 | B1 * | 11/2006 | Staerzl | B63H 20/36 205/727 |
| 2010/0147703 | A1 * | 6/2010 | Glass | C23F 13/06 205/733 |
| 2016/0258424 | A1 | 9/2016 | Nielsen | |
| 2016/0362193 | A1 | 12/2016 | Bemis | |

FOREIGN PATENT DOCUMENTS

| | | | | |
|---|---|---|---|---|
| CN | 106086900 | A | 11/2016 | |
| CN | 208508194 | U | 2/2019 | |
| CN | 110114955 | A | 8/2019 | |
| GB | 1462931 | A | 1/1977 | |
| JP | H08133184 | A | 5/1996 | |
| KR | 101066104 | B1 | 9/2011 | |
| KR | 101874318 | B1 * | 7/2018 | B63H 23/34 |
| WO | WO-9114018 | A1 * | 9/1991 | C23F 13/06 |

OTHER PUBLICATIONS

International Search Report and Written Opinion for corresponding International Application No. PCT/EP2019/078423 mailed Jul. 21, 2020 (10 pages).

Chinese Office Action dated May 4, 2023 in corresponding Chinese Patent Application No. 201980101369.2, 6 pages.

* cited by examiner

PROPELLER ARRANGEMENT IN A CATHODIC PROTECTION SYSTEM

CROSS-REFERENCE TO RELATED APPLICATIONS

This application is a U.S. National Stage application of PCT/EP2019/078423, filed Oct. 18, 2019 and published on Apr. 22, 2021, as WO 2021/073759, all of which is hereby incorporated by reference in its entirety.

TECHNICAL FIELD

The present invention relates to a propeller arrangement in a cathodic protection system for protecting metal parts of a marine construction, such as a marine surface vessel or a marine structure. The system comprises a propeller according to the invention and an optional reference electrode, wherein the metal parts, the propeller arrangement and the reference electrode are adapted to be at least partly immersed in an electrolyte in the form of fresh or salt water in which the marine construction is at least partly immersed. The invention also relates to a marine vessel with such a propeller arrangement.

BACKGROUND

Marine fouling is a well-known problem for many marine applications. The build-up of marine organisms such as algae, mussels and barnacles on the exterior surfaces of the hulls and propulsion units of marine vessels will result in reduced performance, due to the increased resistance between the hull and water flowing past the hull. This will in turn result in increased fuel consumption. It is of particular interest to keep the propeller clean because of the increased drag effect from marine growth on propeller blades moving at high speed through the water. In severe cases, hull resistance and propeller drag might result in loss of maneuverability, which can become a safety concern. In addition, sea water is a corrosive environment for most metal parts used for marine propulsion units, which require cathodic protection not to corrode.

An efficient way of providing corrosion and marine growth protection is the use of a method termed impressed current cathodic protection (ICCP). ICCP systems are often used on cargo carrying ships, tankers and larger pleasure craft. KR101066104B1 discloses the general principle for an ICCP system wherein a metal element and an anode are attached to a vessel and immersed in water. The metal element is connected to the negative terminal and the anode is connected to the positive terminal of a source DC electrical power to provide an electric de-passivation current through an electrical circuit including the anode, the metal element and the electrolyte. In this way, the anode provides corrosion protection for the metal part.

A problem with a standard ICCP system is that they can be quite bulky. For larger vessels this is less of a problem, as the increase in drag caused by externally mounted ICCP units is small in relation to the drag of a relatively large hull. For relatively small vessels, however, the problem of added drag and/or limit available space on or near the transom can become an issue. For vessels used as pleasure craft, externally mounted ICCP units can also cause aesthetic issues.

A further problem is that many types of relatively smaller vessels equipped with, for instance, stern drives or outboard engines can have very limited physical space available on the transom or the hull where ICCP units could be fitted.

Vessels of this type are usually provided with less efficient passive sacrificial anode protection.

A further problem is that cathodic protection of propellers or using propellers as anodes or cathodes is complicated as the propeller needs to be electrically connected to a power source.

The invention provides an improved propeller arrangement aiming to solve the above-mentioned problems.

SUMMARY

An object of the invention is to provide a propeller arrangement in a cathodic protection system, which solves the above-mentioned problems.

The object is achieved by a propeller arrangement and a vessel provided with such a propeller arrangement according to the appended claims.

In the subsequent text, the cathodic protection system according to the invention is described for application to a marine propulsion system in the form of a stern drive mounted to a transom on the vessel. However, the inventive arrangement is also applicable to, for instance, azimuthing or pod drives and outboard drives. The cathodic protection system according to the invention involves an impressed current cathodic protection (ICCP) arrangement which is operated using direct current (DC). In the subsequent text, the power source used for supplying DC power to the arrangement is not necessarily a battery, but the power source can be any suitable source of electrical power such as a fuel cell or a source of alternating current (AC) provided with an AC/DC rectifier.

In the text, the term "slip ring connector" relates to a device for passing current into a rotating device, or from one rotating device into another. Typically, a slip ring connector comprises a slip ring or conductor ring consisting of a stationary or rotating graphite or metal contact, e.g. a brush, which rubs against a facing surface of a rotating metal ring. As the metal ring turns, the electric current is conducted through the stationary brush to the metal ring making the connection. The brush and the metal ring are mounted onto a pair of annular components arranged to be rotatable relative to each other. The annular components have facing radial or circumferential surfaces on which the mating contactors are located. Additional ring/brush assemblies can be provided along the rotating axis if more than one electrical circuit is needed. According to one example, either the brushes or the rings are stationary and the other component rotates. Alternatively both the brushes or the rings and the other component rotate. The electrical components, including the brush, conductor ring, and any electrical connectors are made of highly conductive materials. The materials are selected based on requirements such as current density, voltage drop, rotational speed, temperature, resistance variation and characteristic impedance. Power is generally transmitted through composite brushes of a carbon-graphite base and may have other metals such as copper or silver to increase current density.

The text below refers to an IP Code (International Protection Rating) consisting of the letters IP followed by two digits and an optional letter. The first digit indicates the level of protection that the enclosure provides against access to hazardous parts (e.g., electrical conductors, moving parts) and the ingress of solid foreign objects. The second digit indicates the level of protection that the enclosure provides against harmful ingress of water. An IP code or rating classifies and rates the degree of protection provided by mechanical casings and electrical enclosures against intrusion, dust, accidental contact, and water. The IP codes are defined in the international standard IEC 60529.

According to a first aspect of the invention, a propeller arrangement is provided in a cathodic protection system for a marine vessel with a marine propulsion system. The marine propulsion system comprises at least one driveline housing at least partially submerged in water, a torque transmitting drive shaft extending out of each driveline housing and at least one propeller mounted on the drive shaft. According to the invention, the at least one propeller is electrically isolated from its drive shaft and each electrically isolated propeller is connected to a positive terminal of a direct current power source. The vessel can comprise one or more driveline housings comprising a single drive shaft with a propeller, or counter-rotating propellers with coaxial drive shafts. The cathodic protection system can use at least one or preferably all propellers making up the propulsion system. The at least one propeller is electrically isolated from its drive shaft. Each electrically isolated propeller is electrically connected to a slip ring connector, which slip ring connector is in electrical connection with the positive terminal.

In operation, the propeller arrangement provides cathodic protection, wherein each metallic component to be protected against corrosion is connected to a negative terminal of the direct current power source. Similarly, at least one active anode is connected to a positive terminal of the direct current power source. The cathodic protection system can be provided with a control unit is arranged to regulate the voltage and current output from the direct current power source. The cathodic protection system is an impressed current cathodic protection (ICCP) arrangement using at least one active anode. An active anode can either be a hull mounted anode or at least one propeller forming an anode. The at least one metallic component to be protected forms a cathode and can be the at least one driveline housing, at least one trim tab, seawater intake, swimming platform and/or at least a portion of the vessel hull. If a hull mounted anode is used, then the at least one propeller forms a cathode. Note that this is a non-exclusive list of metallic components suitable for marine growth and corrosion protection. For a propeller anode, the ICCP arrangement provides marine growth protection for the at least one such anode. In the subsequent text, the term "anode" or "active anode" will be used to denote active anodes connected to a power source. Other types of anodes will be specifically referred to as "passive anodes" or "sacrificial anodes"; passive anodes are not connected to DC power.

According to one example, each propeller hub has a slip ring connector attached to the propeller hub upstream in the power flow direction. In this context the "power flow direction" is defined as the direction in which torque is transferred from drive unit, such as an ICE or an electric motor, through a driveline transmission, and to a propeller driveshaft during normal forward operation of the vessel. Each slip ring connector attached to a respective propeller hub is arranged to extend axially or radially from an internal surface in its associated propeller hub for attachment either to a driveline housing or to an adjacent propeller hub located upstream in the power flow direction. The slip ring connector preferably has an annular or cylindrical shape and is arranged surrounding and radially spaced from the outer periphery of the drive shaft. There must be no electrical contact between the drive shaft and the slip ring connector.

According to a further example, the slip ring connector comprises a pair of annular components assembled into a unit and arranged to be rotatable relative to each other. The annular components can have facing radial or circumferential surfaces with mating contactors for transferring electrical power. The mating contactors can comprise a brush and a metal ring through which the electric current is conducted between the moving component parts of the slip ring connector. One or both the annular components is arranged to be rotatable. For instance, the slip ring connector can be mounted between a first propeller hub and the driveline housing. In this case, one annular component is attached to the first propeller and is arranged to be rotatable, while the other annular component is mounted fixed against rotation on the driveline housing. Alternatively, a further slip ring connector is mounted between the first propeller hub and a counter-rotating second propeller hub. In this case, both annular components attached to the first and second propellers, respectively, are arranged to be rotatable. However, transfer of electrical power is possible both when the propellers are rotating and when they are stopped. In this way cathodic protection can be provided both when the vessel is moving and when it is moored or docked.

The use of slip ring connectors for supplying electrical power to a propeller eliminates the need for physical wiring within the rotating components. The elimination of wiring avoids problems with vibrations and/or unbalance when the propellers rotate at relatively high speeds.

According to one example, the component parts of the slip ring connector are exposed to the surrounding marine environment. In this example, any metallic component part of each slip ring connector is made from an inert metallic material, such as titanium. This prevents any such component part from being oxidized and dissolved while being submerged in sea water and connected to the positive or negative side of a DC current source. Similarly, the at least one propeller in the propeller arrangement is made from an inert metallic material, such as titanium.

According to a further example, the component parts of the slip ring connector forms an assembled unit that is sealed against the surrounding marine environment. In this example, a protection rating of at least IP68 is required for a sealed and continuously immersed slip ring connector operated in a saline, corrosive marine environment.

According to a further example, the at least one propeller is electrically isolated from its drive shaft by a torque transmitting electrically isolating component mounted between the at least one propeller and its respective drive shaft. The electrically isolating component is mounted in a gap formed by the outer surface of the drive shaft and the inner surface of the propeller hub. The torque transmitting electrically isolating component can be made from an elastic material, such as a natural or synthetic rubber. The at least one propeller is made from an inert material, such as titanium, niobium or a similar suitable metal or metal alloy.

According to a further example, a dielectric shield can be provided between the at least one propeller and the drive shaft on which the propeller is mounted. A dielectric shield is used as an electrical insulator that can be polarized by an applied electric field. When a dielectric material is placed in an electric field, electric charges do not flow through the material as they do in an electrical conductor but only slightly shift from their average equilibrium positions causing dielectric polarization. Because of dielectric polarization, positive charges are displaced in the direction of the field and negative charges shift in the opposite direction. This creates an internal electric field that reduces the overall field within the dielectric itself. In this arrangement the dielectric shield is used to protect the surface of the drive shaft near the propeller hub from hydrogen embrittlement and local overprotection caused by unacceptably high potentials in areas adjacent the at least one propeller, in particular when a propeller is used as an anode. Local overprotection can cause adjacent surfaces of the drive shaft to become too negatively polarized, wherein a dielectric shield is provided to prevent high current densities on those surfaces.

The dielectric shield can comprise a layer of dielectric material extending along the drive shaft over at least the entire axial extension of the propeller hub. A dielectric material is a substance that is a poor conductor of electricity, but an efficient supporter of electrostatic fields. A non-exclusive list of suitable materials for use in such a dielectric shield includes polymer or polymer-ceramic materials with suitable dielectric properties.

According to a further example, the cathodic protection system comprises a reference electrode that is at least partially submerged in water and is connected to the control unit in order to provide a ground reference value. The ground reference value is used to determine the effectiveness of the cathodic protection system. In response to this determination, the control unit can regulate or fine tune the voltage and current output from the direct current power source.

According to a second aspect of the invention, the invention relates to a marine vessel that is protected by a cathodic protection system comprising a propeller arrangement as described above. The cathodic protection system can be operated using an on-board source of DC power, alternatively using DC power or converted AC power supplied from a shore facility, in order to conserve the on-board power source.

According to a first example the arrangement according to the invention can solve at least in part the problem of added drag caused by externally mounted ICCP units. By using an existing component, in this case a propeller, as the active anode of an ICCP system, added drag from an externally mounted active anode is avoided. Using a propeller as the anode also avoids any aesthetic issues caused by extra components mounted on the hull or transom. The invention also solves the problem of limited physical space available on the transom or the hull for vessels with stern drives or outboard, as the anode can be replaced by the at least one propeller. The invention also solves the problem of supplying electrical power to a propeller without requiring physical wiring within the rotating components. The elimination of wiring extending along or through drive shafts avoids problems with vibrations and/or unbalance when the propellers rotate at high speeds. The arrangement provides protection against fouling caused by marine growth for the propellers and simultaneously provides corrosion protection for metallic components connected to the arrangement.

According to a second example the arrangement according to the invention can solve at least in part the problem of electrically connecting propellers to be corrosion protected by an ICCP system. In this example the propellers form cathodes to be connected to a negative terminal of a power source. In the same way as above, the invention solves the problem of supplying electrical power to one or more propellers without requiring physical wiring within the rotating components. The elimination of wiring extending along or through drive shafts avoids problems with vibrations and/or unbalance when the propellers rotate at high speeds.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
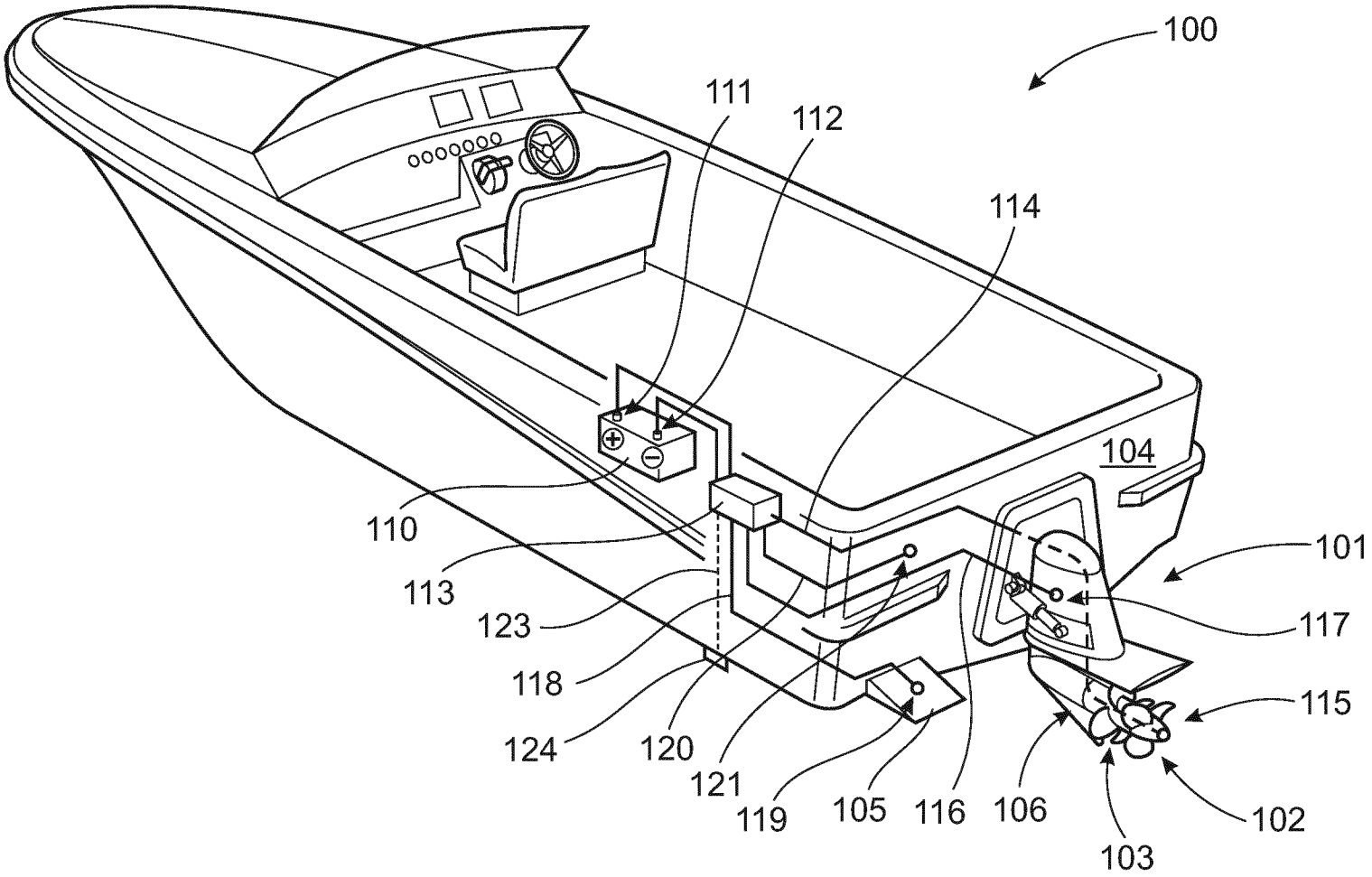
FIG. 1 shows a schematically illustrated vessel comprising a marine cathodic protection system/corrosion protection system according to the invention.
Figure 2A:
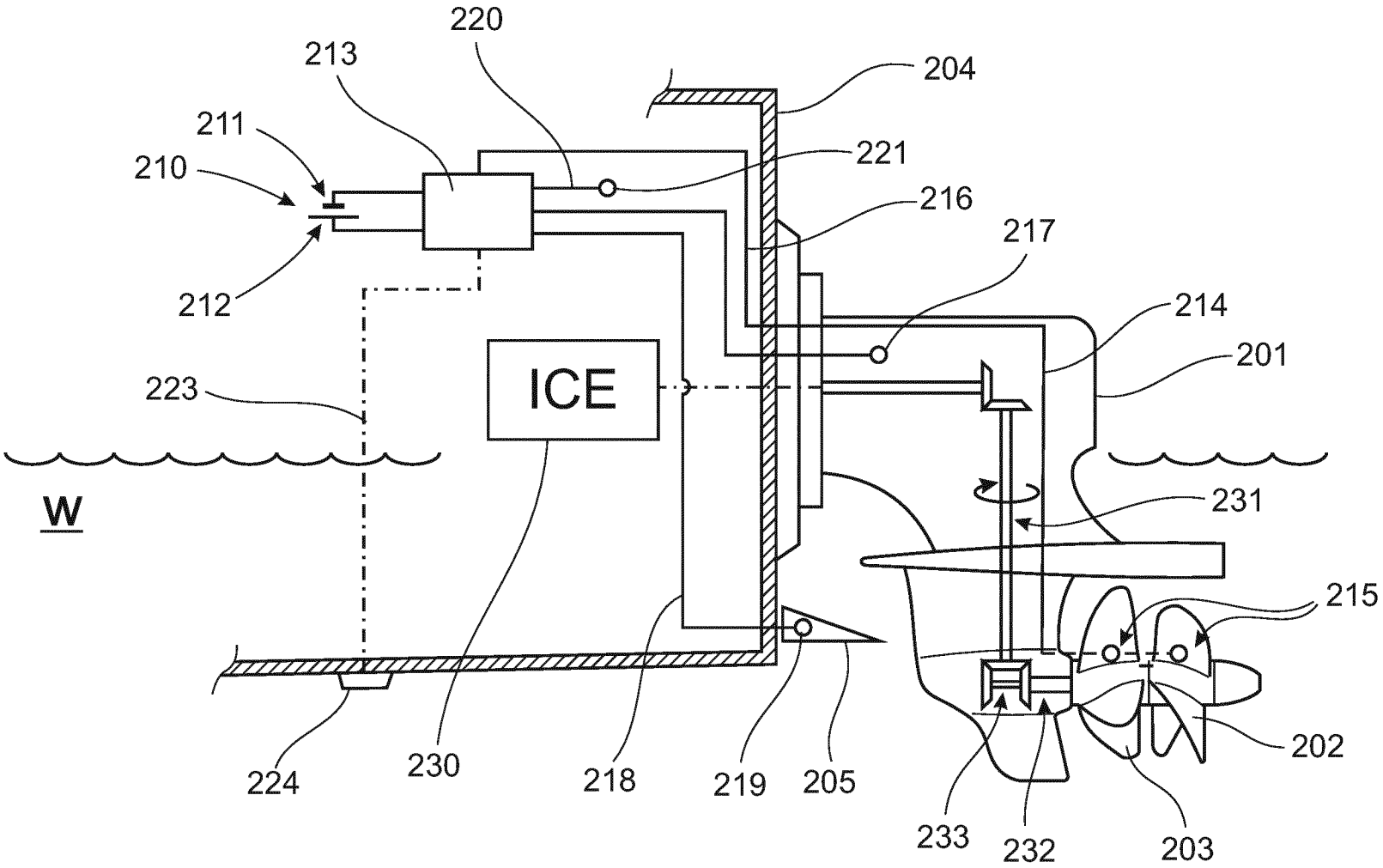
FIG. 2A-B show schematic cross-sections of the rear portion of the marine vessel.
Figure 2B:
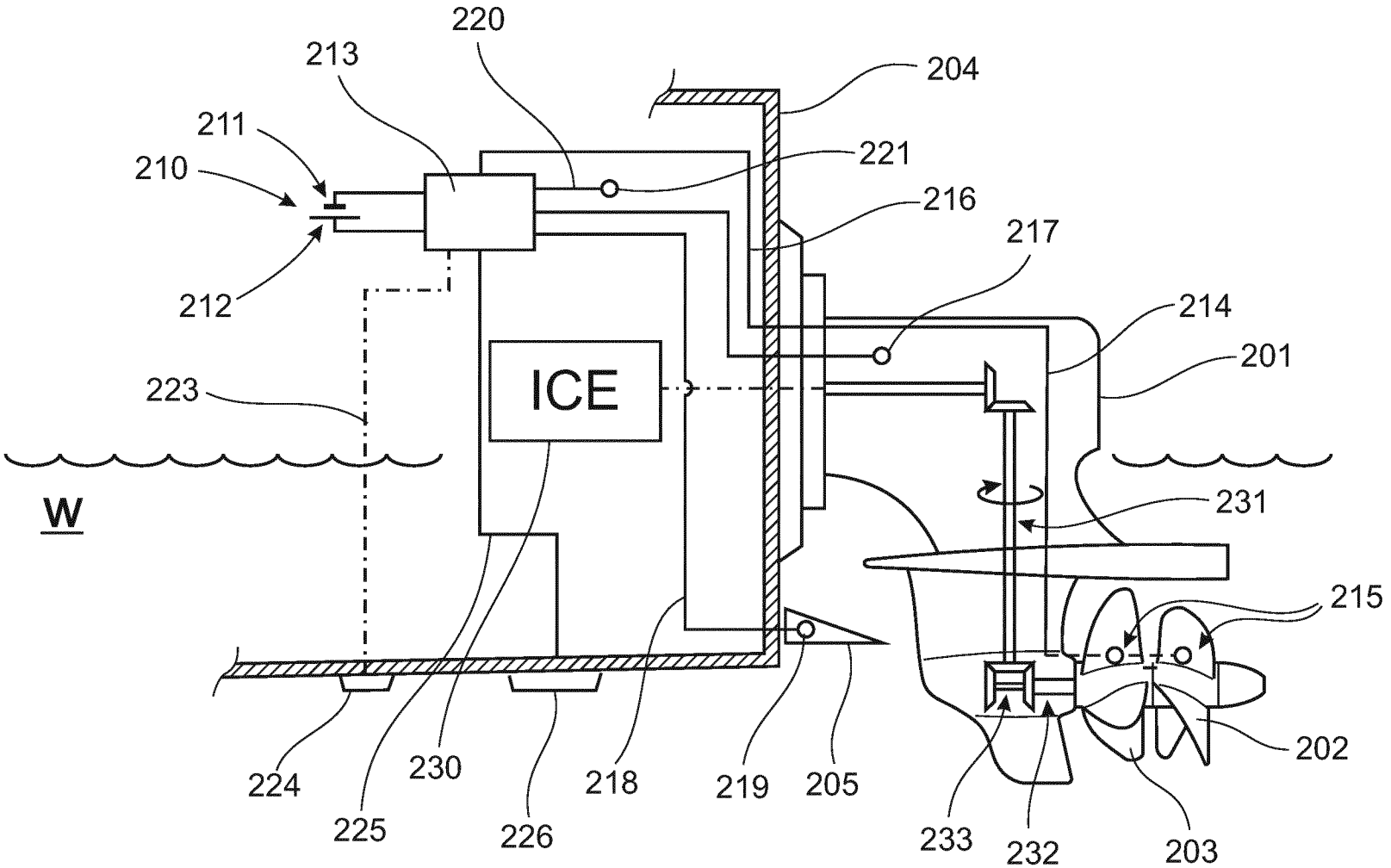

FIG. 1 shows a schematically illustrated marine vessel 100 comprising a cathodic protection system according to the invention. The vessel comprises a hull with a transom 104 to which a marine propulsion system is attached. The propulsion system in this example comprises a single driveline housing 101 at least partially submerged in water, a torque transmitting drive shaft 106 (not shown) extending out of the driveline housing 101, and a pair of counter-rotating propellers 102, 103 mounted on the drive shaft 106. In the current example, both propellers 102, 103 are electrically isolated from its drive shaft 106. The drive shaft arrangement is shown in FIGS. 2A and 2B and will be described in further detail below. Each electrically isolated propeller 102, 103 to be protected against fouling is connected to a positive terminal 111 of a direct current (DC) power source 110, such as a battery, in order to form an anode. Further, each metallic component 101, 104, 105 to be protected against corrosion is connected to a negative terminal 112 of the direct current power source 110, in order to form cathodes. A control unit 113 is connected to the direct current power source 110 and distributes current to all component parts forming an electrical circuit. The control unit 113 is arranged to regulate the voltage and current output from the direct current power source 110. In order to assist regulation of the voltage and current output a reference electrode 124 is mounted on the hull remote from the anode and connected to the control unit 113 via an electrical wire 123. The reference electrode 124 measures a voltage difference between itself and the metallic components, which is directly related to the amount of protection received by the anode. The control unit 113 compares the voltage difference produced by the reference electrode 124 with a pre-set internal voltage. The output is then automatically adjusted to maintain the electrode voltage equal to the pre-set voltage. Alternatively, the control unit can control the current to regulate the voltage to a desired potential.

Regulation of the voltage and current output from the direct current power source can be controlled to automate the current output while the voltage output is varied. Alternatively, the voltage and current output from the direct current power source can be controlled to automate the voltage output while the current output is varied. This allows the protection level to be maintained under changing conditions, e.g. variations in water resistivity or water velocity. In a sacrificial anode system, increases in the seawater resistivity can cause a decrease in the anode output and a decrease in the amount of protection provided, while a change from stagnant conditions results in an increase in current demand to maintain the required protection level.

With ICCP systems protection does not decrease in the range of standard seawater nor does it change due to moderate variations in current demand. An advantage of ICCP systems is that they can provide constant monitoring of the electrical potential at the water/hull interface and can adjust the output to the anodes in relation to this. An ICCP system comprising a reference electrode is more effective and reliable than sacrificial anode systems where the level of protection is unknown and uncontrollable.

The cathodic protection system is an impressed current cathodic protection (ICCP) arrangement using the propellers 102, 103 as an anode 115. In FIG. 1, the metallic component to be protected against corrosion is the driveline housing 101, the trim tabs 105 (one shown), and a metal portion of the hull, in this case the transom 104. Note that this is a non-exclusive list of metallic components suitable for marine growth and corrosion protection. In order to achieve this, the positive terminal 111 and the negative terminal 112 of the battery 110 are connected to the control unit 113. The control unit 113 is arranged to connect the positive terminal 111 to the propellers 102, 103 via a first electrical wire 114. The control unit 113 is further arranged to connect the negative terminal 112 to an electrical connector 117 on the driveline housing 101 via a second electrical wire 116. The negative terminal 112 is also connected to an electrical connector 119 on the trim tab 105 via a third electrical wire 118, and connected to an electrical connector 121 on the transom 104 via a fourth electrical wire 120.

FIG. 2A shows a cross-section of the rear portion of the marine vessel 100 of FIG. 1, through a transom 204 and a driveline housing 201. The single driveline housing 201 is partially submerged in water and comprises torque transmitting drive shafts 232, 233 extending out of the driveline housing 201. A pair of counter-rotating propellers 202, 203 is mounted on their respective drive shafts 233, 232. In this example, the drive shafts 232, 233 are driven by an internal combustion engine ICE via a transmission 231. Transmissions for driving counter-rotating propellers are well known in the art and will not be described in detail here. Alternative drive units for driving the propellers are possible within the scope of the invention. Both propellers 202, 203 are electrically isolated from its respective drive shaft 232, 233 (see FIG. 3). As schematically indicated in FIG. 2A, each electrically isolated propeller 202, 203 is connected to a positive terminal 211 of a direct current power source 210 at schematically indicated points 215 via electrical wiring 214. The electrical connection of the propellers will be described in further detail below. Further, each metallic component 201, 204, 205 to be protected against fouling is connected to a negative terminal 212 of the direct current power source 210. A control unit 213 is arranged to regulate the voltage and current output from the direct current power source 210. As described above, the positive terminal 211 and the negative terminal 212 of the battery 210 are connected to the control unit 213. The control unit 213 is arranged to connect the positive terminal 211 to the propellers 202, 203 via a first electrical wire 214. The control unit 213 is further arranged to connect the negative terminal 212 to an electrical connector 217 on the driveline housing 201 via a second electrical wire 216. The negative terminal 212 is also connected to an electrical connector 219 on the trim tab 205 (one shown) via a third electrical wire 218, and connected to an electrical connector 221 on the transom 204 via a fourth electrical wire 220. A reference electrode 224 is mounted on the hull remote from the propellers 202, 203 forming an anode and connected to the control unit 213 via an electrical wire 223. Regulation of the voltage and current output from the direct current power source using the control unit 213 has been described above.

FIG. 2B shows an alternative cross-section of the rear portion of the marine vessel 100 of FIG. 1, through a transom 204 and a driveline housing 201. As in FIG. 2A, the single driveline housing 201 is partially submerged in water and comprises torque transmitting drive shafts 232, 233 extending out of the driveline housing 201. A pair of counter-rotating propellers 202, 203 is mounted on their respective drive shafts 233, 232. In this example, the drive shafts 232, 233 are driven by an internal combustion engine ICE via a transmission 231. Transmissions for driving counter-rotating propellers are well known in the art and will not be described in detail here. Alternative drive units for driving the propellers are possible within the scope of the invention. Both propellers 202, 203 are electrically isolated from its respective drive shaft 232, 233 (see FIG. 3).

As schematically indicated in FIG. 2B, each electrically isolated propeller 202, 203 is connected to a negative terminal 211 of a direct current power source 210 at schematically indicated points 215 via electrical wire 214. This differs from the example in FIG. 2A in that a hull mounted active anode 226 is used, while the propellers 202, 203 form cathodes to be protected. The electrical connection of the propellers and the other metallic components will be described in further detail below. Each metallic component 201-205 form a cathode to be protected against corrosion if connected to a negative terminal 212 of the direct current power source 210. A control unit 213 is arranged to regulate the voltage and current output from the direct current power source 210 to provide a desired potential for each component. For instance, the control unit 213 is arranged to control the voltage to the propellers towards a different potential relative to the other metallic components, as the propellers can be made from a more noble alloy than most other metallic parts thus requiring a less electronegative protection potential, which can significantly reduce the required cathodic protection current. According to one example, the voltage supplied to the propellers can be −500 mV and the voltage supplied to the driveline housing can be −950 mV. As described above, the positive terminal 211 and the negative terminal 212 of the battery 210 are connected to the control unit 213. The control unit 213 is arranged to connect the negative terminal 211 to the propellers 202, 203 via a first electrical wire 214. The control unit 213 is further arranged to connect the negative terminal 212 to an electrical connector 217 on the driveline housing 201 via a second electrical wire 216. The negative terminal 212 is also connected to an electrical connector 219 on the trim tab 205 (one shown) via a third electrical wire 218, and connected to an electrical connector 221 on the transom 204 via a fourth electrical wire 220. The negative terminal 212 is also connected to the hull mounted active anode 226 via a fifth electrical wire 225. Finally, a reference electrode 224 is mounted on the hull remote from the propellers 202, 203 forming an anode and connected to the control unit 213 via a separate electrical wire 223. Regulation of the voltage and current output from the direct current power source using the control unit 213 has been described above.

Figure 3:
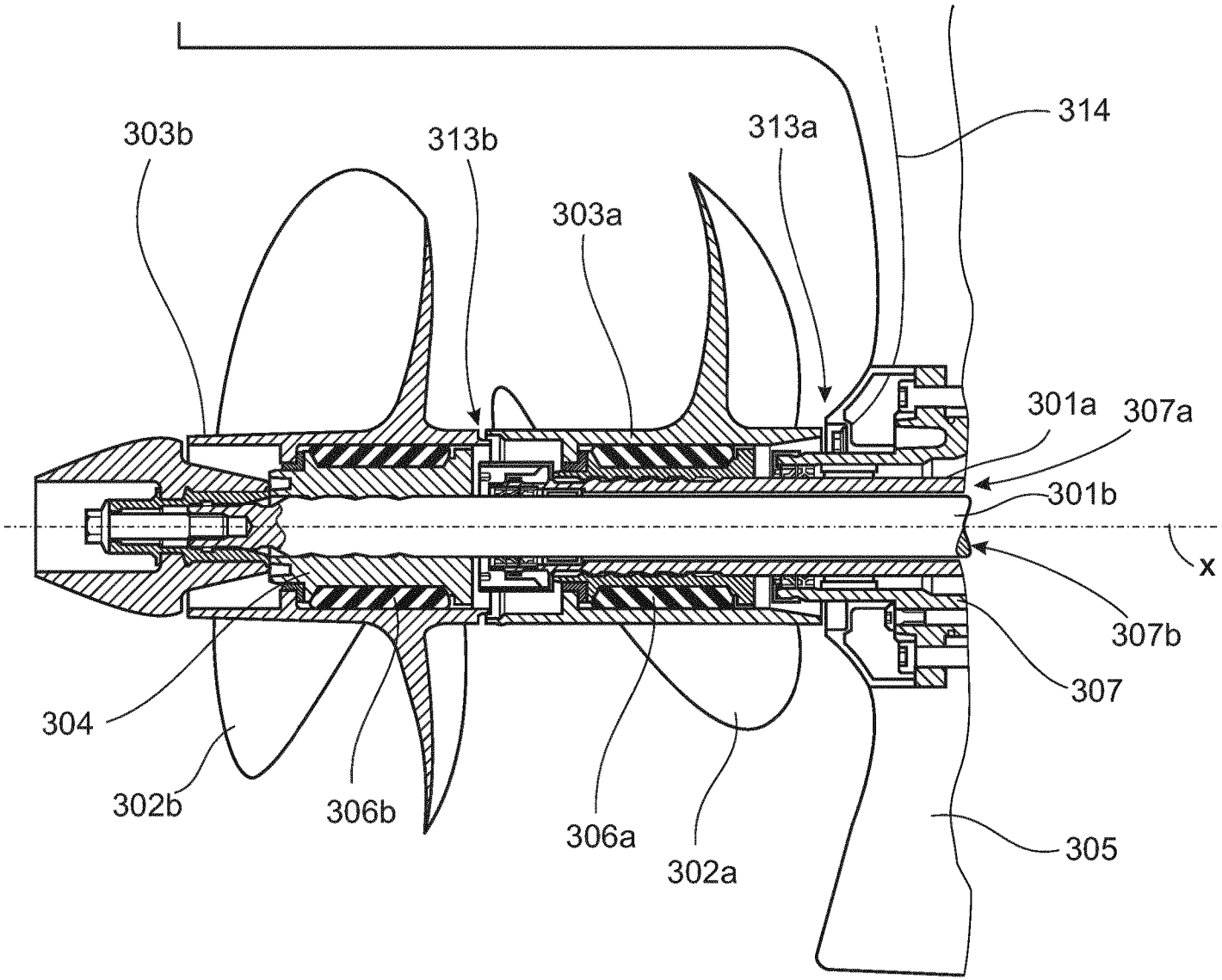
FIG. 3 shows schematic cross-sections through a twin propeller arrangement.

FIG. 3 shows a schematic cross-section of a counter-rotating propeller arrangement suitable for use with the invention. FIG. 3 shows a pair of propellers 302*a*, 302*b* which are electrically isolated from their respective drive shafts 301*a*, 301*b* by a torque transmitting electrically isolating component 306*a*, 306*b* mounted between the respective propeller 302*a*, 302*b* and its drive shaft 301*a*,

301*b*. The electrically isolating component is mounted in a gap formed by the outer surfaces of the respective drive shaft 301*a*, 301*b* and the inner surface of the corresponding propeller hub 303*a*, 303*b*. The torque transmitting electrically isolating component 306*a*, 306*b* can be made from an elastic material, such as a natural or synthetic rubber. A dielectric shield 307*a*, 307*b* is provided between each propeller hub 303*a*, 303*b* and the drive shaft 301*a*, 301*b* on which the respective propeller is mounted. The dielectric shield is used as an electrical insulator that can be polarized by an applied electric field. When a dielectric material is placed in an electric field, electric charges do not flow through the material as they do in an electrical conductor but only slightly shift from their average equilibrium positions causing dielectric polarization. Because of dielectric polarization, positive charges are displaced in the direction of the field and negative charges shift in the opposite direction. This creates an internal electric field that reduces the overall field within the dielectric itself. In this arrangement the dielectric shield 307*a*, 307*b* is used to protect the surface of the drive shafts 301*a*, 301*b* near the propeller hubs 303*a*, 303*b* from hydrogen embrittlement caused by unacceptably high potentials in areas adjacent each propeller 302*a*, 302*b* that is subjected to a sufficiently high electrical field in the cathodic protection system. The dielectric shield can comprise a layer of dielectric material extending along the drive shaft over at least the entire axial extension of the propeller hub 303*a*, 303*b*. A dielectric material is a substance that is a poor conductor of electricity, but an efficient supporter of electrostatic fields. A non-exclusive list of suitable materials for use in such a dielectric shield includes polymer or polymer-ceramic materials with suitable dielectric properties. The dielectric shield is preferably arranged to extend a predetermined length in front of and behind the respective propeller hubs 303*a*, 303*b*, respectively, in order to ensure that the protection potential at the point of contact with the shaft does not become too electronegative. The longitudinal extension of the dielectric shield will vary depending on factors such as anode/cathode area, propeller hub design and the protection current used for the actual application.

In the example shown in FIG. 3, the driveline is a conventional duo-prop driveline, that comprises a drive shaft driving a transmission (see FIGS. 2A-B) located within a driveline housing 305. The duo-prop driveline allows the first propeller 302*a* mounted onto the outer first drive shaft 301*a* and a second propeller 302*b* mounted onto an inner second drive shaft 301*b* to be rotated in opposite directions. The figure also shows a cylindrical spacer part 304 fixed to the end of the inner second drive shaft 301*b*, which spacer part 304 allows the propeller hubs 303*a*, 303*b* to be located at the same radial distance from the axis of rotation X. Counter-rotating propeller arrangements of this type are well known in the art and will not be described in further detail.

Figure 4B:
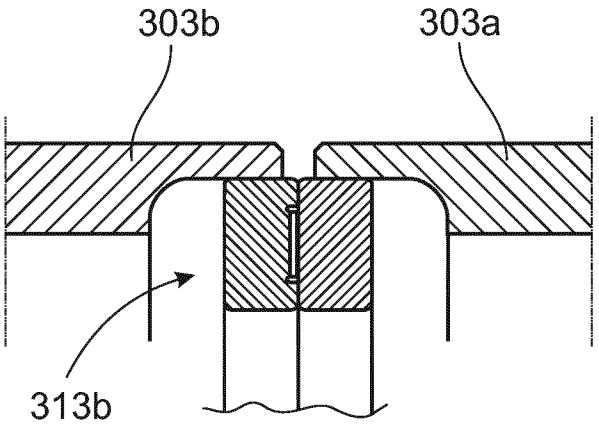
FIGS. 4A-B show cross-sectional views of slip ring connectors in FIG. 3.
Figure 4A:
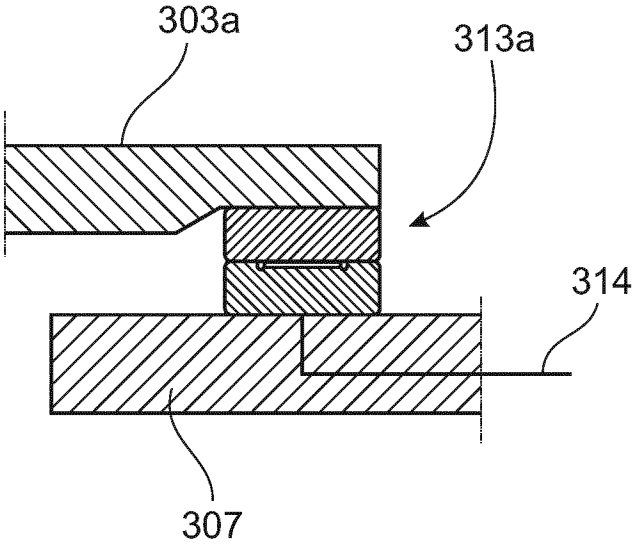

The propellers 302*a*, 302*b* are connected to the positive terminal of a direct current power source (see FIGS. 2A-B) via slip ring connectors 313*a*, 313*b*. A first slip ring connector 313*a* is mounted between a tubular support 307 fixed to the driveline housing 305 and the first propeller hub 303*a*. The tubular support 307 extends out of the driveline housing 305 and provides support for bearings and sealing arrangements surrounding the second drive shaft 301*a*. The first slip ring connector 313*a* transfers electrical current from an electrical wire 314 connected to the positive terminal of the power source (see FIGS. 2A-B) to the first propeller hub 303*a* of the first propeller 302*a*. The first slip ring connector 313*a* is made up of an assembled unit comprising two annular components which are rotatable relative to each other. The first slip ring connector 313*a* comprises slip ring or conductor ring consisting of a stationary or rotating graphite or metal contact, e.g. a brush, which rubs against a facing surface of a rotating or stationary metal ring. In this example, the component mounted onto the driveline housing 305 is stationary, while the component mounted onto the first propeller hub 303*a* is rotatable. As one component turns, the electric current is conducted through the stationary brush to the metal ring making the connection. The brush and the metal ring are mounted onto a pair of annular components arranged to be rotatable relative to each other as shown in FIGS. 4A and 4B. According to one example, the annular components can have facing radial surfaces on which the mating contactors are located. According to a further example, the annular components can have facing circumferential surfaces on which the mating contactors are located. A second slip ring connector 313*b* is mounted between the first propeller hub 303*a* and the second propeller hub 303*b*. The second slip ring connector 313*b* transfers electrical current from the first propeller hub 303*a* to the second propeller hub 303*b* of the second propeller 302*b*. The second slip ring connector 313*b* is made up of an assembled unit comprising two annular components which are rotatable relative to each other, similar to the first slip ring connector 313*a* described above. In this example, the component mounted onto the first propeller hub 303*a* and the component mounted onto the second propeller hub 303*b* are rotatable in opposite directions. The electrical components, including the brush, conductor ring, and any electrical connectors are made of highly conductive materials. The materials are selected based on requirements such as current density, voltage drop, rotational speed, temperature, resistance variation and characteristic impedance. Power is generally transmitted through composite brushes of a carbon-graphite base and may have other metals such as copper or silver to increase current density.

A control unit (se FIGS. 1-2B) is arranged to monitor and regulate the voltage and current output from the direct current power source in order to maintain a desired voltage potential for the cathodic protection system. The control unit is arranged to compensate for any voltage drop caused by the first and second slip ring connectors.

The use of slip ring connectors 313*a*, 313*b* for supplying electrical power to one or more propellers eliminates the need for physical wiring within the rotating components. The elimination of wiring extending along or in the drive shafts avoids problems with vibrations and/or unbalance when the propellers rotate at relatively high speeds. Although FIG. 3 shows an embodiment for a duo-prop arrangement, the figure is also considered to show the corresponding layout for a single propeller arrangement, which would only comprise the first slip ring connector between the driveline housing and the first propeller.

FIGS. 4A and 4B show cross-sectional views of the slip ring connectors in FIG. 3. FIG. 4A shows the first slip ring connector 313*a* mounted between a tubular support 307 fixed to the driveline housing (see FIG. 3) and the first propeller hub 303*a*. The first slip ring connector 313*a* transfers electrical current from an electrical wire 314 connected the positive terminal of the power source to the first propeller hub 303*a* of the first propeller 302*a*. The first slip ring connector 313*a* is made up of an assembled unit comprising two annular components arranged concentrically and having facing circumferential surfaces on which mating contactors are located. The inner annular component mounted on the tubular support 307 must be electrically isolated from said tubular support 307, e.g. by a suitable coating or an intermediate component (not shown) made from an isolating material, such as natural or synthetic rubber.

FIG. 4B shows the second slip ring connector 313*b* mounted between the first propeller hub 303*a* and the second propeller hub 303*b*. The second slip ring connector 313*b* transfers electrical current from the first propeller hub 303*a* to the second propeller hub 303*b* of the second propeller 302*b*. The second slip ring connector 313*b* is made up of an assembled unit comprising two annular components having facing radial surfaces on which mating contactors are located. In this example, the annular components can be made from an inert metallic material, such as titanium, niobium or a similar suitable metal or metal alloy It is to be understood that the present invention is not limited to the embodiments described above and illustrated in the drawings; rather, the skilled person will recognize that many changes and modifications may be made within the scope of the appended claims.

The invention claimed is:

1. Propeller arrangement in a cathodic protection system for a marine vessel with a marine propulsion system, which cathodic protection system comprises a direct current power source; the propulsion system comprising;

at least one driveline housing at least partially submerged in water;

a torque transmitting drive shaft extending out of the driveline housing;

at least one propeller mounted on the drive shaft;

wherein the at least one propeller is electrically isolated from its drive shaft in an interface between an outer circumferential surface of the drive shaft and an inner circumferential surface of the propeller;

each electrically isolated propeller is electrically connected to a slip ring connector; which slip ring connector is in electrical connection with a terminal of the direct current power source.

2. Propeller arrangement according to claim 1, wherein each propeller hub has a slip ring connector attached to the hub upstream in the power flow direction.

3. Propeller arrangement according to claim 1, wherein the slip ring connector is annular and arranged surrounding and spaced from the drive shaft.

4. Propeller arrangement according to claim 1, wherein the slip ring connector is mounted onto an internal surface at one end of the propeller hub.

5. Propeller arrangement according to claim 1, wherein the slip ring connector is mounted between a first propeller hub and the driveline housing.

6. Propeller arrangement according to claim 5, wherein a further slip ring connector is mounted between a first propeller hub and a second propeller hub.

7. Propeller arrangement according to claim 1, wherein each slip ring connector is made from an inert metallic material.

8. Propeller arrangement according to claim 1, wherein the at least one propeller is made from an inert metallic material.

9. Propeller arrangement according to claim 1, wherein a torque transmitting electrically isolating component is mounted between the at least one propeller and the drive shaft.

10. Propeller arrangement according to claim 1, wherein a dielectric shield is provided between the at least one propeller and the drive shaft.

11. Propeller arrangement according to claim 10, wherein the dielectric shield comprises a layer of dielectric material extending along the drive shaft over at least the entire axial extension of the propeller hub.

12. Propeller arrangement according to claim 1, wherein slip ring connector is in electrical connection with a positive terminal of the direct current power source, so that the at least one propeller forms an anode.

13. Propeller arrangement according to claim 1, wherein slip ring connector is in electrical connection with a negative terminal of the direct current power source so that the at least one propeller forms a cathode.

14. Marine vessel wherein the marine vessel is protected by a propeller arrangement according to claim 1.

* * * * *